US012765730B2

(12) United States Patent
Kleine Doepke et al.

(10) Patent No.: US 12,765,730 B2
(45) Date of Patent: Oct. 20, 2026

(54) VACUUM CLEANER NOZZLE

(71) Applicant: KONINKLIJKE PHILIPS N.V., Eindhoven (NL)

(72) Inventors: Bastian Cornelis Kleine Doepke, Zuidhorn (NL); Albert Al-Shorachi, Zwolle (NL)

(73) Assignee: VERSUNI HOLDING B.V., Eindhoven (NL)

( * ) Notice: Subject to any disclaimer, the term of this patent is extended or adjusted under 35 U.S.C. 154(b) by 487 days.

(21) Appl. No.: 17/416,841

(22) PCT Filed: Jan. 10, 2020

(86) PCT No.: PCT/EP2020/050475
§ 371 (c)(1),
(2) Date: Jun. 21, 2021

(87) PCT Pub. No.: WO2020/148165
PCT Pub. Date: Jul. 23, 2020

(65) Prior Publication Data

US 2022/0079403 A1 Mar. 17, 2022

(30) Foreign Application Priority Data

Jan. 18, 2019 (EP) ..... 19152585

(51) Int. Cl.
*A47L 9/06* (2006.01)
*A47L 9/00* (2006.01)

(52) U.S. Cl.
CPC ..... *A47L 9/0606* (2013.01); *A47L 9/009* (2013.01)

(58) Field of Classification Search
CPC ... A47L 5/28; A47L 9/009; A47L 9/02; A47L 9/06; A47L 9/0606; A47L 9/0613; A47L 9/062; A47L 9/0626; A47L 9/068
(Continued)

(56) References Cited

U.S. PATENT DOCUMENTS 3,659,313 A * 5/1972 Ferris ..... A47L 9/06 15/417
5,123,141 A * 6/1992 Erickson ..... A47L 9/02 15/396

(Continued)

FOREIGN PATENT DOCUMENTS

CN 102014721 A 4/2011
CN 105142477 A 12/2015

(Continued)

OTHER PUBLICATIONS

Translation of DE 202012005866 U1 (Year: 2012).*

(Continued)

*Primary Examiner* — David S Posigian
*Assistant Examiner* — Steven Huang
(74) *Attorney, Agent, or Firm* — Maschoff Brennan

(57) ABSTRACT

Vacuum cleaner nozzle (N), comprising an air inlet area (AIA) having a front-end boundary (FEB), the front-end boundary (FEB) having a predetermined number of front openings (FO), and front guide elements (FGE) having a surface at an angle to the front-end boundary (FEB) for guiding dirt towards the front openings (FO), openings left by the front guide elements being aligned with the front openings (FO), a width of the openings left by the front guide elements (FGE) not exceeding 300% of a width of the front openings (FO). The front-end boundary (FEB) preferably has between 4 and 6 front openings (FO). An aperture of the front openings (FO) is preferably between 5×5 $mm^2$ and 7×7 $mm^2$.

11 Claims, 1 Drawing Sheet

(58) Field of Classification Search
USPC ..... 15/393, 398, 401, 402, 415.1, 416, 422
See application file for complete search history.

(56) References Cited

U.S. PATENT DOCUMENTS

| | | | | |
|---|---|---|---|---|
| 9,681,785 | B2 | 6/2017 | Kleine-Doepke | |
| 2003/0163889 | A1* | 9/2003 | Bagwell | A47L 9/02 15/398 |
| 2010/0319159 | A1* | 12/2010 | Gell | A47L 9/0606 15/415.1 |
| 2012/0151713 | A1* | 6/2012 | Krebs | A47L 9/0626 15/415.1 |
| 2015/0223655 | A1 | 8/2015 | Cole | |
| 2016/0213215 | A1 | 7/2016 | Voorhorst | |
| 2018/0333027 | A1 | 11/2018 | Mcintosh | |
| 2021/0177223 | A1* | 6/2021 | Der Marderosian | A47L 9/009 |

FOREIGN PATENT DOCUMENTS

| | | | | |
|---|---|---|---|---|
| CN | 105392407 | A | 3/2016 | |
| CN | 206044539 | U | 3/2017 | |
| DE | 3444724 | A1 * | 6/1986 | |
| DE | 4037432 | A * | 8/1991 | A47L 9/02 |
| DE | 102008021353 | A1 * | 11/2009 | A47L 9/06 |
| DE | 202012005048 | U1 | 7/2012 | |
| DE | 202012005866 | U1 * | 7/2012 | A47L 9/0606 |
| EP | 1396221 | A1 | 3/2004 | |
| EP | 3025626 | A1 | 6/2016 | |
| GB | 517894 | A | 2/1940 | |
| GB | 2477138 | A | 7/2011 | |
| GB | 2498205 | A | 7/2013 | |
| JP | H1147046 | A | 2/1999 | |
| JP | 2009285355 | A | 12/2009 | |
| JP | 3167137 | U | 3/2011 | |
| JP | 2017502773 | A | 1/2017 | |
| WO | 2009133031 | A1 | 11/2009 | |
| WO | 2011089407 | A1 | 7/2011 | |
| WO | 2015150084 | A1 | 10/2015 | |
| WO | 2020043537 | A1 | 3/2020 | |

OTHER PUBLICATIONS

Translation of DE 4037432 A (Year: 1991).*
Translation of DE 102008021353 A1 (Year: 2009).*
Translation of DE 202012005866 U1 (Year: 2020).*
International Search Report and Written Opinion of PCT/EP2020/050475, dated May 6, 2020.

* cited by examiner

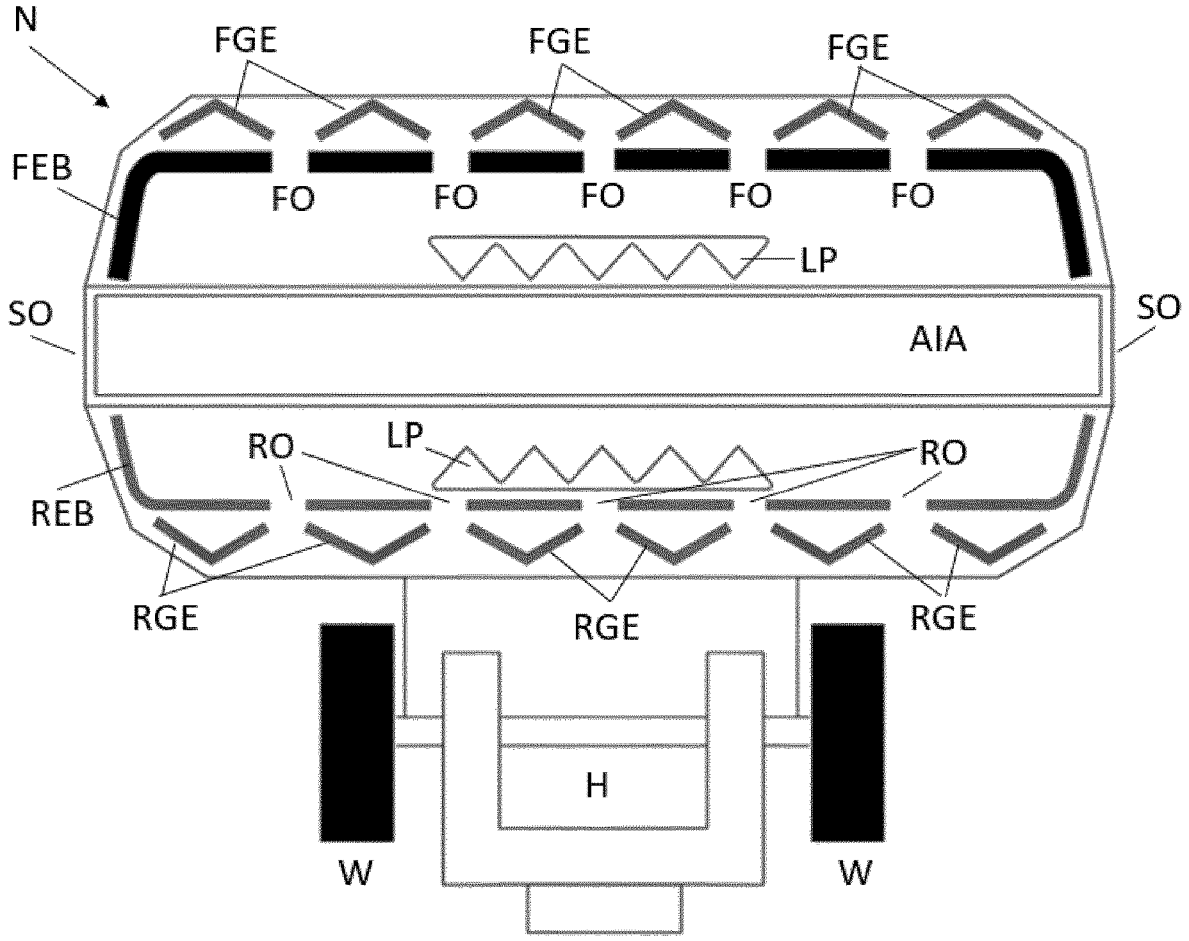
N
FGE
FGE
FGE
FEB
FO
FO
FO
FO
FO
LP
SO
AIA
SO
RO
LP
RO
REB
RGE
RGE
RGE
H
W
W

VACUUM CLEANER NOZZLE

FIELD OF THE INVENTION

The invention relates to a vacuum cleaner nozzle, and a vacuum cleaner provided with such a vacuum cleaner nozzle.

BACKGROUND OF THE INVENTION

EP 3 003 111 B1 discloses a nozzle for a vacuum cleaner, the nozzle comprising a base having an edge, a suction aperture in the base, and at least one flexible flap protruding from the base between the edge and the suction aperture, the flexible flap having first and second sections separable by an opening. The first and second sections are arranged to be urged towards each other when the nozzle is moved in a first direction in which the edge is a leading edge to close the opening or tend the opening towards closing, and to be urged away from each other when the nozzle is moved in a second direction in which the edge is a trailing edge to open the opening or to further open the opening.

WO 2009/133031 A1 discloses a vacuum cleaner nozzle, in particular for use in an advance and reverse direction, having a nozzle head and a nozzle base, in which at least one suction port is implemented, from which dirt catching elements are disposed upstream at least in the advance direction, which are disposed rigidly on the nozzle head and/or the nozzle base and/or are implemented so they can be at least partially countersunk into the nozzle head, wherein at least a part of said dirt catching elements have a cross section tapering away from said suction port in said advance and/or reverse directions such that a hollow area acting as a dirt trap is implemented on the side facing toward said suction port, wherein openings for the passage of dirt particles are provided laterally to each dirt catching element. The nozzle according to the invention is equally suitable for receiving coarse and also fine dirt on hard floors or on carpets. In particular, it can be implemented as a floor or cushion nozzle or also as a so-called furniture brush.

US 2018/333027 A1 discloses a suction nozzle that has two auxiliary suction paths which are generally the same as one another in structure and function. The auxiliary suction paths are spaced along with width of the suction chamber. More particularly, one auxiliary suction path is positioned around ¼ of the way along the width of the suction chamber and the other auxiliary suction path is positioned around ¾ of the way along the width of the suction chamber. Each auxiliary suction path extends from an entrance at the front of the suction nozzle (i.e. the part of the suction nozzle that faces forwards from the perspective of the user during normal use), and opens into a suction chamber. Each auxiliary suction path is defined by an open-bottomed channel formed in the underside in that each path has a top wall and side walls, but no bottom wall. In use, the bottom wall of each auxiliary suction path is formed by the surface being cleaned. The entrance of each auxiliary suction path tapers from a wider upstream portion (at the front of the entrance) to a narrower downstream portion (at the rear of the entrance). Extending between the entrance of each auxiliary suction path and the suction chamber is a passage of generally rectangular cross section. The auxiliary suction paths are configured to form large debris paths. They are therefore relatively large in cross section, to allow large debris to pass through them and into the suction chamber. The narrowest point of each auxiliary suction path in this particular case is the height of its passage (i.e. the distance between the top wall of the passage and a surface being cleaned), which is around 6 mm. A Dyson pneumatic cleaner head similarly has two openings, but they have a smaller width than in this patent application.

US 2016/213215 A1 discloses a vacuum cleaner head having a base and a suction opening in the base. An array of flexible flaps protrudes from the base. The flexible flaps are configured to act on a surface to be cleaned. The flexible flaps are spaced from each other to allow the passage of detritus there-between in a predefined arrangement. The predefined arrangement of the flexible flaps is configured to promote a non-linear flow path through the array of flexible flaps between an end of the base and the suction opening. A gap between first and second rows of flaps is substantially equal to or greater than a space between adjacent flexible flaps in each of the first and second rows. The rows do not need to be straight rows; for example, curved rows are alternatively possible. With this arrangement it is possible to create a non-linear path to the suction opening which will help maximize air resistance and so ensure a high vacuum is generated by the vacuum cleaner head. Therefore, cleaning performance of the vacuum cleaner head is improved. Furthermore, the flexible flaps help to form a seal with the surface to be cleaned whilst allowing the passage of detritus to the suction opening. The provision of flexible flaps may aid the dislodgement of detritus from a surface to be cleaned due to the resilience of the flaps. Furthermore, the flexible flaps are urged against the surface to be cleaned. The array of flexible flaps may also help define an elongate air flow path between the end of the base and the suction opening that provides a high resistance to the passage of air to help maximize the detritus pick-up capabilities of the vacuum cleaner head.

Due to increasingly strict energy label requirements relating to vacuum cleaners, there is a need to perform well on dust pick up levels on hard floors with crevices. To achieve a high performance on hard floors with crevices, the brush strips in the nozzle should be as closed as possible at the front and rear sides of the nozzle. This enables the highest possible air flow levels through the sides of the nozzle, enabling a high crevice performance.

However, for a user it is also important to be able to pick up large particles as rice and crumbs. To enable a good pick up of such large particles, the brushes should have many and large sized openings (>5×5 mm) to enable the particles to enter the nozzle.

These two performance aspects (crevice cleaning+coarse dust pick up) lead to contradicting requirements with respect to the brush. The difficulty in trade-off between requirements is more urgent now than in the past. Due to EU regulations, the input power level of the vacuum cleaners has gone down, and is still decreasing. This requires optimizations that were not needed in the past. To get an A+ or an A++ energy label, input power levels may not exceed 450-700 W. Lower than ever before.

Currently, some manufacturers solve this issue by delivering 2 nozzles in the box:

- a special crevice nozzle, which has closed brushes at front and back side of the nozzle OR brushes with only very limited number and size of apertures. The rear brush can alternatively be a rubber strip.
- a normal nozzle to allow for coarse dust pick up, which have lots of openings and mostly also large sized openings (>5×5 $mm^2$).

There are even nozzles that have open brushes that can be closed or covered by the user by providing an additional switch or lever. This requires an action by the user to switch between the two modes during the cleaning job. Such extra switching and sliding mechanisms add an additional burden on the user.

SUMMARY OF THE INVENTION

It is, inter alia, an object of the invention to provide an improved vacuum cleaner nozzle. The invention is defined by the independent claims. Advantageous embodiments are defined in the dependent claims.

One aspect of the invention provides a vacuum cleaner nozzle, comprising an air inlet area having a front-end boundary, the front-end boundary having a predetermined number of front openings, and front guide elements having a surface at an angle to the front-end boundary for guiding dirt towards the front openings, openings left by the front guide elements being aligned with the front openings, a width of the openings left by the front guide elements not exceeding 300% of a width of the front openings.

As the width of the openings left by the front guide elements does not exceed 300% of the width of the front openings, the front guide elements are able to more or less directly shift the dirt towards the front openings without there being a need for an airflow parallel to a front end of a nozzle, as a sufficiently strong air flow may not be present with low-power appliances that get favorable energy labels. Preferably, the width of the openings left by the front guide elements does not exceed 200% of the width of the front openings, and more preferably, the width of the openings left by the front guide elements matches the width of the front openings, so that dirt is easily shifted into the front openings. The same holds, mutatis mutandis, for a width of the openings left by the rear guide elements in relation to a width of the rear openings.

The front-end boundary preferably has between 4 and 6 front openings. This allows for a much easier access to the air inlet area than if there are only 2 front openings.

An aperture of the front openings is preferably between 5×5 $mm^2$ and 7×7 $mm^2$. This size provides a good compromise between low air leakage needed to get a good crevice performance, and a suitable ability to suck up dirt particles on the floor.

In a practical embodiment, the nozzle is supported by the front-end boundary at a front of the nozzle, and by wheels at a rear end of the nozzle. The front-end boundary may be a brush strip, for example.

Embodiments allows for favorable energy labels and a good dirt pick-up, also as regards relatively large particles. Embodiments provide a nozzle configuration that delivers both crevice and coarse dust pick up performance in 1 setting, so without the need for the user to switch between nozzles, or operate a switch or lever on a nozzle during use on hard floors. This configuration can be used for a hard-floor-only nozzle, or, as a hard floor setting in a multi-purpose nozzle where the user can switch between a hard floor setting and a soft floor setting.

To solve the contradiction between a closed brush (to guarantee a good crevice performance) and a brush with many and large openings (to enable coarse pick up), embodiments are based on the idea to use only a few openings in the brush, while ensuring that all coarse dust will enter the nozzle via these openings by guiding such coarse dirt towards these openings via V-shaped flexible (e.g. rubber) guide members in front of the brush. Such a 'zigzag' geometry ensures that all coarse particles will be guided towards the openings in the brush. This enables that the number of openings in the brush can be very limited, e.g. 4 to 6 (e.g. 5) apertures is preferred, which limited number of openings would be insufficient to allow good coarse pick up in a configuration without zigzag elements as coarse dirt would mainly be moved forward by the closed parts of the brush. Preferably, a size of the openings should be between 5×5 $mm^2$ and 7×7 $mm^2$.

In respect of the front guide elements, it is noted that it may be practical for the front guide elements to be flexible and/or to be configured to reach to a surface to be cleaned in use of the nozzle on such a surface, for wiping dirt towards the front openings.

Preferably, the air inlet area has a rear-end boundary having a predetermined number of rear openings, and the nozzle further comprises rear guide elements having a surface at an angle to the rear-end boundary for guiding dirt towards the rear openings, openings left by the rear guide elements being aligned with the rear openings, a width of the openings left by the rear guide elements not exceeding 300% of a width of the rear openings. Similar to what has been noted in respect of the front-end boundary, it is preferred if the rear-end boundary has between 4 and 6 openings and/or if an aperture of the rear openings is between 5×5 $mm^2$ and 7×7 $mm^2$. The rear-end boundary may be formed by a flexible strip, for example.

The invention also relates to a vacuum cleaner provided with a nozzle described in the preceding paragraphs, a suction generator for generating an airflow through the nozzle, and a dirt separation unit for separating dirt from the airflow.

Another aspect of the invention provides a vacuum cleaner nozzle, comprising an air inlet area having a front-end boundary, the front-end boundary having a predetermined number of front openings, and flexible front guide elements having a surface at an angle to the front-end boundary for guiding dirt towards the front openings, openings left by the front guide elements being aligned with the front openings, wherein both the front-end boundary and the front guide elements are configured to reach to a surface to be cleaned in use of the nozzle on such a surface. In the following, an overview of options which are applicable to this other aspect of the invention will be provided, wherein it is noted that a number of options are the same as mentioned in the foregoing with respect to the one (first) aspect of the invention, and wherein it is noted that options may be taken alone or in any possible combination.

According to a first option, the front-end boundary has between 4 and 6 front openings.

According to a second option, an aperture of the front openings is between 5×5 $mm^2$ and 7×7 $mm^2$.

According to a third option, the nozzle is supported by the front-end boundary at a front of the nozzle, and by wheels at a rear end of the nozzle.

According to a fourth option, the front-end boundary is a brush strip.

According to a fifth option, the air inlet area has a rear-end boundary having a predetermined number of rear openings, wherein the nozzle may further comprise flexible rear guide elements having a surface at an angle to the rear-end boundary for guiding dirt towards the rear openings, openings left by the rear guide elements being aligned with the rear openings. In this respect, it is preferred if both the rear-end boundary and the rear guide elements are configured to reach to a surface to be cleaned in use of the nozzle on such a surface.

According to a sixth option, the rear-end boundary has between 4 and 6 front openings.

According to a seventh option, an aperture of the rear openings is between 5×5 $mm^2$ and 7×7 $mm^2$.

According to an eighth option, the rear-end boundary is formed by a flexible strip.

In the present context of the other aspect, the invention also covers a vacuum cleaner provided with the nozzle of this aspect, a suction generator for generating an airflow through the nozzle, and a dirt separation unit for separating dirt from the airflow, wherein at least one of the above-mentioned options may be applicable to the design of the nozzle.

These and other aspects of the invention will be apparent from and elucidated with reference to the embodiments described hereinafter.

BRIEF DESCRIPTION OF THE DRAWINGS

FIG. 1 shows an embodiment of a nozzle in accordance with the invention.

DESCRIPTION OF EMBODIMENTS

In the embodiment of FIG. 1, a central air-inlet area AIA is delimited by a front-end boundary FEB and a rear-end boundary REB. Each boundary FEB, REB has 5 openings FO, RO. Dirt is guided towards these openings FO, RO by slanted structures FGE, RGE, which are in this embodiment formed by zig-zag flexible (e.g. rubber) strips that each have openings that align with the openings in the front-end boundary FEB and the rear-end boundary REB. These flexible strips preferably reach to the floor, so that all dirt is wiped towards the openings FO, RO. The front-end boundary FEB is formed by a brush. The nozzle N is supported by the brush FEB at the front, and by wheels W at the rear end. In the shown nozzle having single hinge H, which nozzle has no flexibility between soleplate and wheels, the rear-end boundary REB is formed by a flexible (e.g. rubber) strip to prevent over-determined geometry towards the floor, ensuring a good sealing of the brushes FEB and rubbers REB with the floor. The nozzle N has side openings SO that may be 7 mm high and 35 mm wide to get a good crevice performance. The nozzle embodiment of FIG. 1 further has lint pickers LP having a plurality of triangular-shaped elements as described in our earlier application EP18192041.4, incorporated herein by reference.

In an alternative embodiment, this configuration of brush and zigzag can be positioned both at the front side of the nozzle (forward movement of the nozzle) and also at the rear side of the nozzle (for a backward stroke).

When the embodiment of FIG. 1 was tested in combination with a 480 W vacuum cleaner, about 93% of rice and lentils could be picked up in a single stroke, while various prior art vacuum cleaners could only do so at much higher power levels; at comparable power levels much less would be picked up in a single stroke.

The nozzle of FIG. 1 differs from the nozzle of WO 2009/133031 A1 in that the prior art nozzle does not have front and rear boundaries FEB, REB that close off the triangular structures FGE, RGE. The prior art dirt trap at the inside of a triangle will result in a lot of noise, which is avoided in the embodiment of FIG. 1 as the straight brush/strip close the triangular spaces so that they cannot act as dirt trap. The number of openings per front or rear side in WO 2009/133031 A1 is 10, which is twice as large as the number of openings in FIG. 1.

It follows from the foregoing explanation of the nozzle N of FIG. 1 that it is practical and advantageous if the front guide elements FGE are flexible. Also, it is practical and advantageous if the front guide elements are configured to reach to a surface to be cleaned in use of the nozzle on such a surface, for wiping dirt towards the front openings. This may particularly imply that a height of the front guide elements in the nozzle is sufficient for free ends of the front guide elements to touch such a surface. These features of the front guide elements can be very well combined with a front-end boundary FEB that is also configured to reach to a surface to be cleaned in use of the nozzle on such a surface. In this respect, it is noted that another aspect of the invention provides a vacuum cleaner nozzle N, comprising an air inlet area AIA having a front-end boundary FEB, the front-end boundary FEB having a predetermined number of front openings FO, and flexible front guide elements FGE having a surface at an angle to the front-end boundary FEB for guiding dirt towards the front openings FO, openings left by the front guide elements FGE being aligned with the front openings FO, wherein both the front-end boundary FEB and the front guide elements FGE are configured to reach to a surface to be cleaned in use of the nozzle N on such a surface. The front-end boundary may be a brush strip, for example, as already explained in the foregoing. Further, the front-end boundary and the front guide elements which are configured to reach to a surface to be cleaned in use of the nozzle on such a surface may be combined with a rear-end boundary REB having a predetermined number of rear openings RO and flexible properties, wherein it may be practical for the rear-end boundary to be a flexible strip, as explained earlier. In case the nozzle further comprises rear guide elements RGE having a surface at an angle to the rear-end boundary for guiding dirt towards the rear openings, such rear guide elements, like the front guide elements, may be flexible and configured to reach to a surface to be cleaned in use of the nozzle on such a surface.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several means, several of these means may be embodied by one and the same item of hardware. Measures recited in mutually different dependent claims may advantageously be used in combination.

The invention claimed is:

1. A vacuum cleaner nozzle, comprising:

an air inlet area having a front-end boundary formed by a brush strip having a plurality of strip sections, the front-end boundary having a predetermined number of front openings between adjacent strip sections of the plurality of strip sections, the front openings vertically aligned with each other and perpendicular to a front edge of the vacuum cleaner nozzle, wherein the air inlet area has a side opening on each side of the vacuum cleaner nozzle; and front guide elements having triangular structures, a triangular space of each triangular structure is closed off by a corresponding strip section of the front-end boundary for guiding dirt towards the front openings, each opening of a plurality of openings left by the front guide elements aligned with a corresponding front opening in the front-end boundary and being configured to allow shifting of the guided dirt directly towards the corresponding adjacent front openings, a width of the plurality of openings left by the front guide elements is equal to or exceeds a width of the front openings.

2. The vacuum cleaner nozzle as claimed in claim 1, wherein the front-end boundary has between 4 and 6 front openings, and wherein an aperture of the front openings is between 5×5 $mm^2$ and 7×7 $mm^2$.

3. The vacuum cleaner nozzle as claimed in claim 1, wherein the vacuum cleaner nozzle is supported by wheels at a rear end of the vacuum cleaner nozzle.

4. The vacuum cleaner nozzle as claimed in claim 1, wherein the vacuum cleaner nozzle is supported by the front-end boundary at a front of the vacuum cleaner nozzle.

5. The vacuum cleaner nozzle as claimed in claim 1, wherein the front guide elements are flexible.

6. The vacuum cleaner nozzle as claimed in claim 1, wherein the front guide elements are configured to reach to a surface to be cleaned in use of the vacuum cleaner nozzle on such a surface, for wiping dirt towards the front openings.

7. The vacuum cleaner nozzle as claimed in claim 1, wherein the air inlet area has a rear-end boundary having a predetermined number of rear openings, wherein the vacuum cleaner nozzle further comprises rear guide elements having a surface at an angle to the rear-end boundary for guiding dirt towards the rear openings, each opening of a plurality of openings left by the rear guide elements being configured to allow shifting of the guided dirt directly towards the corresponding adjacent rear openings, wherein a width of the openings left by the rear guide elements is equal to or exceeds a width of the rear openings.

8. The vacuum cleaner nozzle as claimed in claim 7, wherein the rear-end boundary has between 4 and 6 rear openings, and wherein an aperture of the rear openings is between 5×5 $mm^2$ and 7×7 $mm^2$.

9. The vacuum cleaner nozzle as claimed in claim 7, wherein the rear-end boundary is formed by a flexible strip.

10. A vacuum cleaner nozzle, comprising:

an air inlet area having a front-end boundary formed by a brush strip having a plurality of strip sections, the front-end boundary having a predetermined number of front openings between adjacent strip sections of the plurality of strip sections, the front openings vertically aligned with each other and perpendicular to a front edge of the vacuum cleaner nozzle, wherein the air inlet area has a side opening on each side of the vacuum cleaner nozzle; and flexible front guide elements having triangular structures, a triangular space of each triangular structure is closed off by a corresponding strip section of the front-end boundary for guiding dirt towards the front openings, each opening of a plurality of openings left by the front guide elements aligned with a corresponding front opening in the front-end boundary and being configured to allow shifting of the guided dirt directly towards the corresponding adjacent front openings, a width of the plurality of openings left by the front guide elements is equal to or exceeds a width of the front openings, wherein both the front-end boundary and the front guide elements are configured to reach a surface to be cleaned in use of the vacuum cleaner nozzle on such a surface.

11. The vacuum cleaner nozzle as claimed in claim 10, wherein the vacuum cleaner nozzle is supported by the front-end boundary at a front of the vacuum cleaner nozzle, and by wheels at a rear end of the vacuum cleaner nozzle.

* * * * *